US006085992A

United States Patent [19]

Chockley et al.

[11] Patent Number: 6,085,992

[45] Date of Patent: Jul. 11, 2000

[54] HYDRAULICALLY-ACTUATED FUEL INJECTOR WITH RATE SHAPING THROUGH RESTRICTED FLOW TO INTENSIFIER PISTON

[75] Inventors: Scott A. Chockley, Market Drayton, United Kingdom; Jeffrey D. Graves, Chenoa, Ill.

[73] Assignee: Caterpillar Inc., Peoria, Ill.

[21] Appl. No.: 09/196,273

[22] Filed: Nov. 19, 1998

[51] Int. Cl.[7] ..... F02M 47/02

[52] U.S. Cl. ..... 239/92; 239/95; 239/533.8

[58] Field of Search ..... 239/533.8, 90, 239/93, 95, 92

[56] References Cited

U.S. PATENT DOCUMENTS

| | | | |
|---|---|---|---|
| 3,469,793 | 9/1969 | Guertler | 239/533.8 X |
| 3,921,604 | 11/1975 | Links . | |
| 4,006,859 | 2/1977 | Thoma et al. | 239/533.8 X |
| 4,516,730 | 5/1985 | Fussner | 239/533.8 |
| 4,907,555 | 3/1990 | Fuchs . | |
| 4,962,887 | 10/1990 | Matsuoka | 239/533.8 X |
| 5,143,291 | 9/1992 | Grinsteiner . | |
| 5,271,371 | 12/1993 | Meints et al. . | |
| 5,297,523 | 3/1994 | Hafner et al. . | |
| 5,335,852 | 8/1994 | Mustean et al. . | |
| 5,423,484 | 6/1995 | Zuo . | |
| 5,464,156 | 11/1995 | Ricco et al. | 239/533.8 X |
| 5,492,098 | 2/1996 | Hafner et al. . | |
| 5,517,972 | 5/1996 | Stockner . | |
| 5,522,545 | 6/1996 | Camplin et al. . | |
| 5,682,858 | 11/1997 | Chen et al. . | |
| 5,738,075 | 4/1998 | Chen et al. . | |

*Primary Examiner*—Kevin Weldon
*Attorney, Agent, or Firm*—Michael B. McNeil

[57] ABSTRACT

A hydraulically actuated fuel injector includes an injector body containing an intensifier piston with a hydraulic surface exposed to fluid pressure in a hydraulic pressure cavity. This hydraulic surface includes an annular taper and moves within a bore due to the pressure in the hydraulic pressure cavity. Prior to the injection event, the intensifier piston is in a retracted position that partially blocks at least one actuation fluid supply passage. At the initiation of the injection event, the partial blocking of the actuation fluid passage results in a slower initial movement rate of the intensifier piston. The injection flow rate is a function of the speed of the intensifier piston. The initial rate shaping is accomplished by controlling the initial speed of the intensifier piston by at least partially blocking one or more of the actuation fluid supply passages.

28 Claims, 3 Drawing Sheets

HYDRAULICALLY-ACTUATED FUEL INJECTOR WITH RATE SHAPING THROUGH RESTRICTED FLOW TO INTENSIFIER PISTON

TECHNICAL FIELD

The present invention relates generally to hydraulically-actuated fuel injection systems, and more particularly to rate shaping injection in hydraulically-actuated fuel injectors.

BACKGROUND ART

It has long been known that combustion efficiency and exhaust emissions can be improved at some engine operating conditions by gradually increasing the mass flow rate of fuel injected into the combustion chamber during an injection event. Two of these injection profiles are oftentimes referred to in the art as a ramp or boot shaped injection. In the field of hydraulically actuated fuel injectors, this type of rate shaping can be accomplished in a number of ways. One method is by controlling the initial velocity profile of a plunger that pressurizes the fuel during each injection cycle. The movement of the plunger in a hydraulically actuated fuel injector can in turn be controlled by controlling the movement rate of the piston, which supplies the downward force to the plunger.

One known method for rate shaping involves creating an initial hesitation in the piston. This can be accomplished by designing geometrical relationships between the piston and the piston bore that prevent the high pressure hydraulic fluid from acting over the complete surface of the piston when the piston begins its downward movement. One example of this method is described in U.S. Pat. No. 5,522,545 to Camplin et. al. In Camplin et al, the geometrical relationship between the cavity and the piston prevents the full pressure of the actuation fluid from acting over the whole area of the piston when the injection event begins, causing the piston to hesitate in its initial downward movement.

In another example, U.S. Pat. No. 3,921,604 to Links describes a fuel injector having an intensifier piston with a conical protuberance on its top side that projects into the high pressure hydraulic fluid supply bore. Links describes this geometry as giving the injector the ability to control the stroke speed of the piston, presumably because the conical portion prevents the high pressure fluid from flowing quickly to act on the remaining surface area of the piston. While Links does recognize that some injection rate shaping capability can be accomplished by the geometrical interrelationship between the piston and the high pressure hydraulic fluid supply bore, the Links geometry suffers from a number of disadvantages which render it difficult to reliably predict performance due to extreme sensitivity to machining tolerances.

The present invention is directed to overcoming one or more of the problems as set forth above.

DISCLOSURE OF THE INVENTION

A hydraulically-actuated fuel injector includes an injector body that defines a supply passage which opens to a hydraulic pressure cavity. A piston that has a hydraulic surface exposed to fluid pressure in the hydraulic pressure cavity is positioned in the injector body. The piston is movable between a retracted position and an advanced position. The piston at least partially blocks the fluid supply passage when in its retracted position.

BEST MODE FOR CARRYING OUT THE INVENTION

Figure 1:
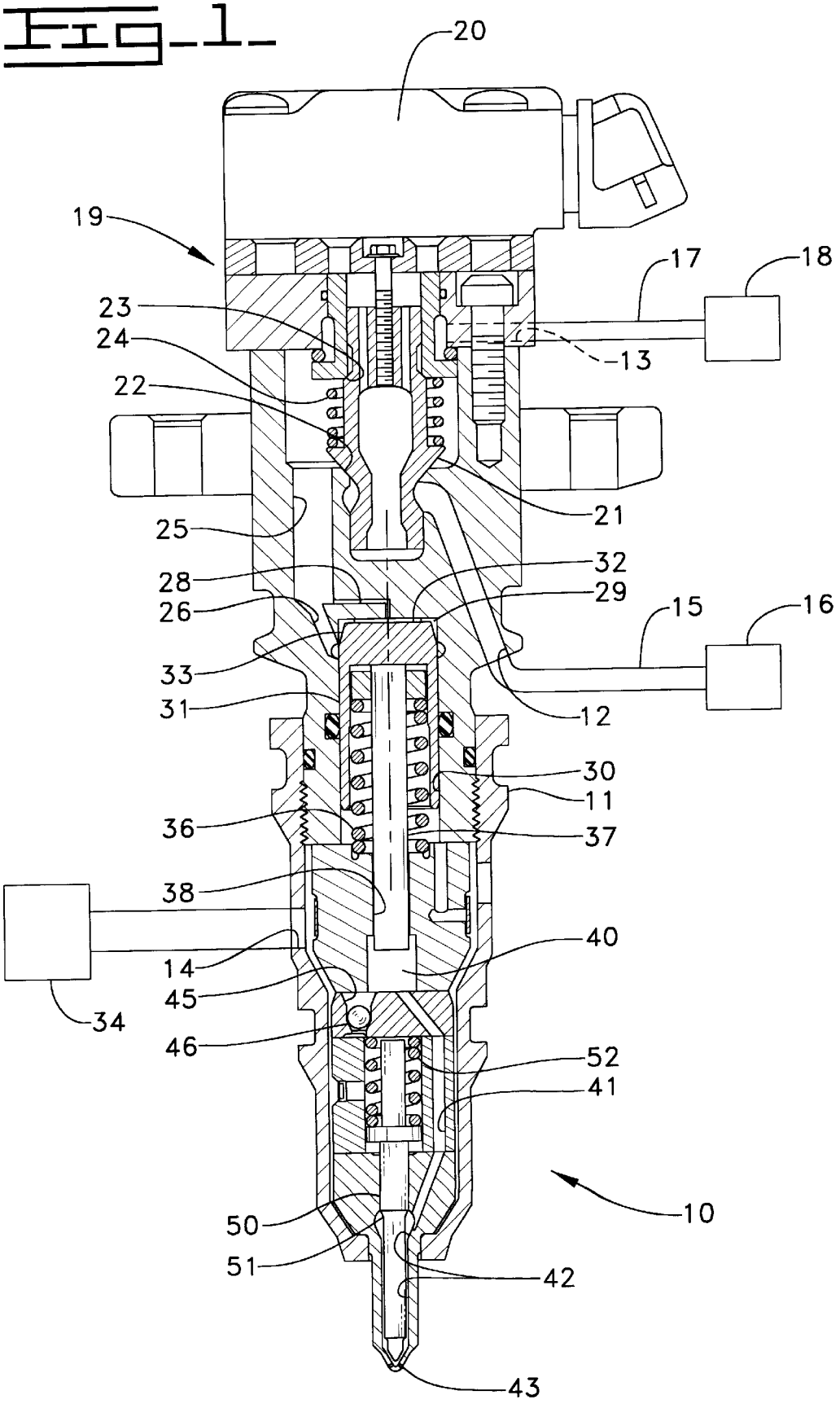
FIG. 1 is a diagrammatic side cross-section of a hydraulically actuated fuel injector according to the preferred embodiment of this invention.
Figure 2:
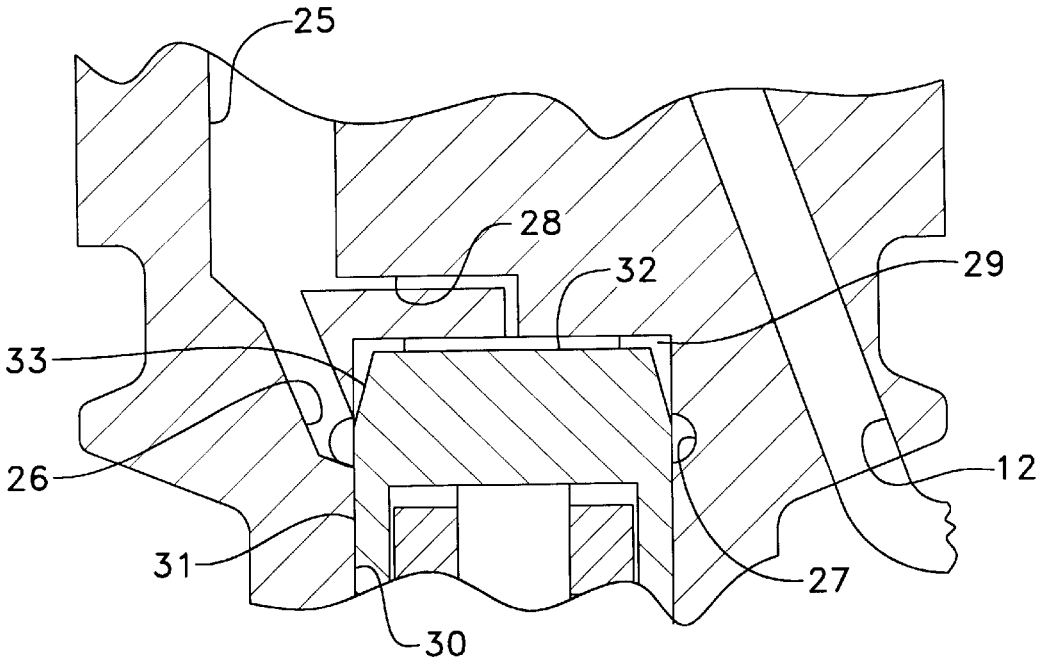
FIG. 2 is a partial diagrammatic side cross-section of the piston portion of the hydraulically actuate fuel injector shown in FIG. 1.

Referring to FIGS. 1 and 2, there is shown a hydraulically actuated fuel injector 10 according to the preferred embodiment of the invention. The fuel injector 10 includes an injector body 11 made up of various components that are attached to one another in a manner well known in the art and positioned as they would be just prior to an injection event. The fuel injector 10 contains a high pressure actuation fluid inlet 12 which can allow actuation fluid to flow into the fuel injector 10 from a source of high pressure actuation fluid 16, via an actuation fluid supply passage 15. The fuel injector 10 also contains a low pressure actuation fluid drain 13 which can allow actuation fluid to flow out of the fuel injector 10 into a drain reservoir 18, via a drain passage 17. Fuel flows into an injector body 11 from a fuel source 34 via an attached fuel inlet 14. While the illustrated embodiment utilizes one fluid as a hydraulic medium, such as oil, and one fluid as a fuel, such as distillate diesel fuel, the same fluid could be used for both purposes. The fuel injector 10 is controlled in operation by a control valve 19.

The control valve 19 includes a control valve member 21 which is attached to a solenoid 20. The control valve member 21 moves within the control valve 19 between a high pressure seat 22 and a low pressure seat 23. When the solenoid 20 is deactivated, the control valve member 21 is biased toward the high pressure seat 22 by a biasing spring 24. When the control valve member 21 is in this position, low pressure actuation fluid contained within an actuation fluid cavity 25 is allowed to exit the fuel injector through the low pressure actuation drain 13 toward a drain reservoir 18 for recirculation. When the solenoid 20 is activated, the control valve member 21 is moved against the action of the biasing spring 24 from the high pressure seat 22 to the low pressure seat 23. This opens the high pressure actuation fluid inlet 12, allowing high pressure actuation fluid to enter the actuation fluid cavity 25 from the source of high pressure actuation fluid 16 via the actuation fluid supply passage 15.

The actuation fluid cavity 25 opens to a hydraulic pressure cavity 29 by a primary actuation fluid passage 26 and a restricted actuation fluid passage 28. Actuation fluid cavity 25 acts as a supply passage to fluidly connect hydraulic pressure cavity 29 to either high pressure actuation fluid inlet 12 or low pressure actuation fluid drain 13, whenever the respective member is open. The hydraulic pressure cavity 29 is the upper portion of a piston bore 30 that is defined by the injector body 11. An intensifier piston 31 moves from a retracted position, as shown in FIG. 1, to an advanced position with the piston bore 30. A return spring 36 biases the intensifier piston 31 toward the retraced position. The intensifier piston 31 has a primary hydraulic surface 32 containing an annular taper 33. The primary hydraulic surface 32 is exposed to fluid pressure within the hydraulic pressure cavity 29. The restricted actuation fluid passage 28 is always open into the hydraulic pressure cavity 29, but the primary actuation fluid passage 26 is blocked by the intensifier piston 31 when it is in the retracted position. The primary actuation fluid passage 26 is unblocked for the majority of the stroke of intensifier piston 31. When the solenoid 20 causes the control valve member 21 to open the high pressure actuation fluid inlet 12, high pressure fluid enters the actuation fluid cavity 25. Both the restricted actuation fluid passage 28 and the primary actuation fluid passage 26 are exposed to the fluid in the actuation fluid cavity 25. However, because the intensifier piston 31 is initially in the retracted position, the primary actuation fluid passage 26 is blocked. High pressure actuation fluid enters the hydraulic pressure cavity 29 through the restricted actuation fluid passage 28, raising the pressure within the hydraulic pressure cavity 29. This increase in pressure in the hydraulic pressure cavity 29 causes the intensifier piston 31 to begin moving downward toward the advanced position against the action of the return spring 36.

The speed of the intensifier piston 31 is a function of the pressure acting on the primary hydraulic surface 32. Therefore, the smaller the restricted actuation fluid passage 28, the slower the initial movement of the intensifier piston 31. As the intensifier piston 31 moves toward the advanced position, the annular taper 33 on the primary hydraulic surface 32 allows for a gradual opening of the primary actuation fluid passage 26, via an annulus 27. As the primary actuation fluid passage 26 is opened, the pressure in the hydraulic pressure cavity 29 begins to increase, thus increasing the speed of the intensifier piston 31 toward the advanced position. Once the annulus 27 is fully open, the flow area within the hydraulic pressure cavity 29 is maximized. This relatively unrestricted flow area allows for a dramatic increase in the pressure within the hydraulic pressure cavity 29, dramatically increasing the pressure acting on the primary hydraulic surface 32 of the intensifier piston 31. Because the speed of the intensifier piston 31 is a function of the pressure on the primary hydraulic surface 32, the speed of the intensifier piston 31 toward the advancing position increases dramatically once the annulus 27 is fully opened.

The intensifier piston 31 is connected to a plunger 37 which moves within a plunger bore 38. As with the intensifier piston 31, the plunger 37 is biased toward its retracted position by the return spring 36. When the intensifier piston 31 begins to advance, the plunger 37 advances in a corresponding fashion. When the plunger 37 moves toward the advanced position, it acts on fuel within a fuel pressurization chamber 40, which is defined by the injector body 11. Fuel can enter the fuel pressurization chamber 40 from the fuel inlet 14 via a fuel supply passage 45. However, a check valve 46 prevents the reverse flow of the fuel back into the fuel supply passage 45. Fuel exits the fuel pressurization chamber 40 via a nozzle supply passage 41. When the pressure of the fuel in the fuel pressurization chamber 40 is below valve opening pressure, a needle valve member 50 prevents the flow of that fuel from the fuel pressurization chamber 40 through the nozzle supply passage 41, by blocking a nozzle outlet 43.

The needle valve member 50 contains a lifting hydraulic surface 51, which is exposed to pressure from the fuel within the nozzle chamber 42, which is connected to the fuel pressurization chamber 40. The fuel pressure exerted on the lifting hydraulic surface 51 creates an upward hydraulic force. The needle valve member 50 is normally biased downward by a biasing spring 52. The fuel pressure within the fuel pressurization chamber 40 builds until valve opening pressure is reached. This pressure is then sufficient to move the needle valve member 50 against the action of the biasing spring 52, opening the nozzle outlet 43. The fuel within the fuel pressurization chamber 40 is then permitted to flow through the nozzle supply passage 41 into a nozzle chamber 42 and out of the nozzle outlet 43. At the end of the injection event, when the fuel pressure within the fuel pressurization chamber 40 drops below valve closing pressure, the needle valve member 50 returns to the biased position closing the nozzle outlet 43 and ending the fuel flow into the combustion space.

Figure 3:
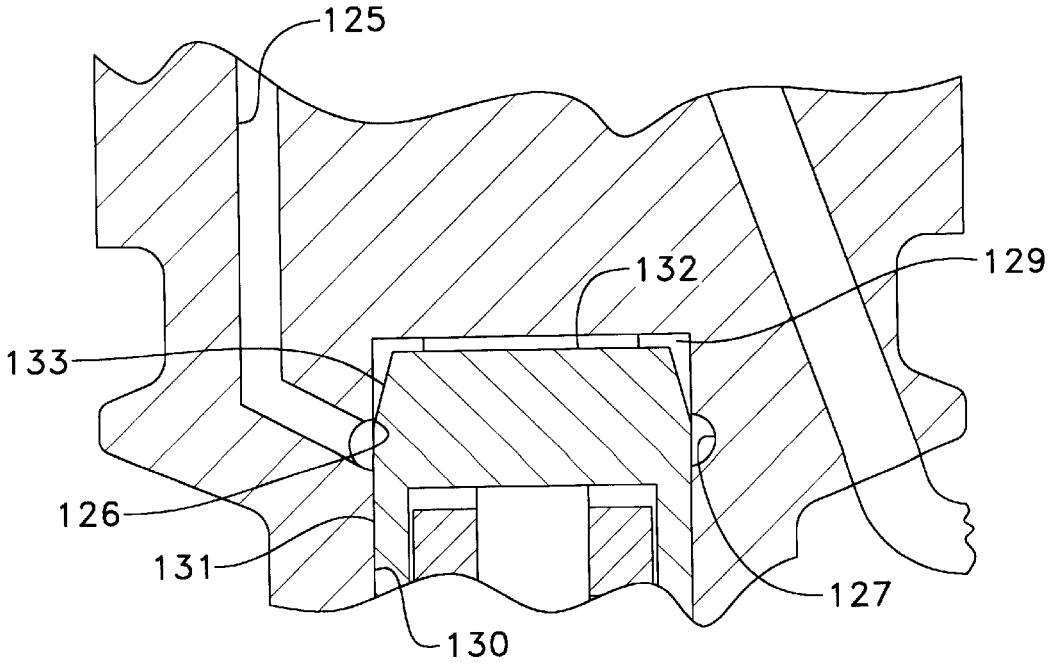
FIG. 3 is a partial diagrammatic side cross-section of the intensifier piston and actuation fluid cavity in another embodiment of this invention.

Referring now to FIG. 3, another embodiment is shown, which is substantially similar to the embodiment shown in FIG. 2 with the exception that only one passage exists for actuation fluid to enter a hydraulic pressure cavity 129. With minor modifications to the fuel injector 10 shown in FIG. 1, the FIG. 3 embodiment can be incorporated into the injector body 11 to make a complete fuel injector 10.

An intensifier piston 131 shown in FIG. 3 has similar features to the intensifier piston 31 shown in FIG. 2. The intensifier piston 131 moves between a retracted position and an advanced position within a piston bore 130. The intensifier piston 131 contains a primary hydraulic surface 132 which includes an annular taper 133, which is exposed to pressure in the hydraulic pressure cavity 129. High pressure fluid contained in an actuation fluid cavity 125 is fluidly connected to the hydraulic pressure cavity 129 via an actuation fluid passage 126 which is partially restricted by the intensifier piston 131. As stated earlier, this actuation fluid passage 126 is the sole channel through which actuation fluid in the actuation fluid cavity 125 can flow into the hydraulic pressure cavity 129.

The annular taper 133 on the primary hydraulic surface 132 allows for a restricted initial flow of fluid into the hydraulic pressure cavity 129 from the actuation fluid passage 126. As the high pressure fluid enters the hydraulic pressure cavity 129, the pressure within the hydraulic pressure cavity 129 begins to rise. This rise in pressure pushes the intensifier piston 131 downward against the action of a return spring, not shown in FIG. 3. (see FIG. 1). As the intensifier piston 131 continues moving downward toward its advanced position, the annular taper 133 gradually opens the actuation fluid passage 126 via an annulus 127. As stated earlier, the speed of the intensifier piston 131 is a function of the pressure within the hydraulic pressure cavity 129, therefore as the pressure increases in the hydraulic pressure cavity 129, the speed of the intensifier piston 131 toward its advanced position increases. Once the primary hydraulic surface 132 of the intensifier piston 131 fully opens the actuation fluid passage 126, the flow rate into the hydraulic pressure cavity 129 increases. This causes the pressure within the hydraulic pressure cavity 129 to increase, thus increasing the speed of the intensifier piston 131.

INDUSTRIAL APPLICABILITY

Referring now to FIGS. 1 and 2, prior to the start of an injection event, low pressure in the fuel pressurization chamber 40 prevails and the actuation fluid cavity 25 is open to the low pressure actuation fluid drain 13, the intensifier piston 31 and the plunger 37 are in their respective retracted positions, and the needle valve member 50 is in its seated position closing the nozzle outlet 43. The injection event is initiated by activation of the solenoid 20. The activation of the solenoid 20 moves the control valve member 21 to the low pressure seat 23, and away from the high pressure seat 22, which opens the high pressure actuation fluid inlet 12. Actuation fluid can now flow into the actuation fluid cavity 25 from the source of high pressure actuation fluid 16, via the actuation fluid supply passage 15. The primary actuation fluid passage 26 and the restricted actuation fluid passage 28 are now exposed to the high pressure actuation fluid within the actuation fluid cavity 25. High pressure actuation fluid begins to enter the hydraulic pressure cavity 29, through the restricted actuation fluid passage 28, causing a rise in the pressure acting on the primary hydraulic surface 32 of the intensifier piston 31.

Figure 4:
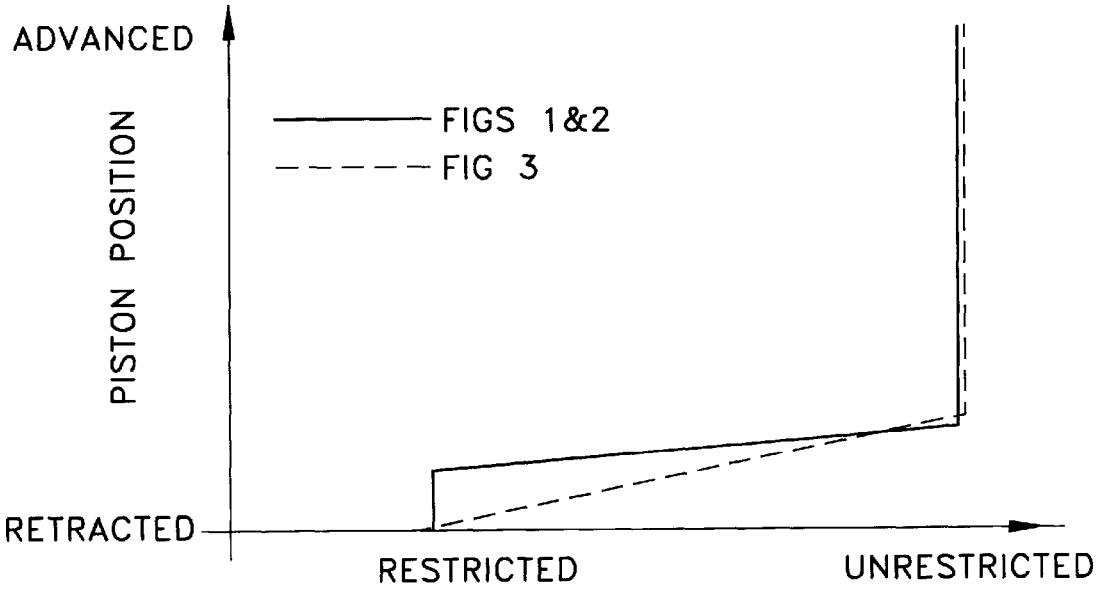
FIG. 4 is a graph of the piston position versus the flow area for the invention embodiments shown in FIGS. 1–2 and 3, respectively.

The rise in pressure within the hydraulic pressure cavity 29 begins to move the intensifier piston 31 toward its advanced position against the bias of the return spring 36. The rate of movement of the piston is a function of the flow area through the restricted actuation fluid passage 28. The downward movement of the intensifier piston 31 moves the plunger 37 against the bias of the return spring 36, closing the check valve 46 and raising the pressure of the fuel within the fuel pressurization chamber 40 and the nozzle supply passage 41. The increasing pressure of the fuel within the nozzle supply passage 41 acts on the lifting hydraulic surface 51 of the needle valve member 50. When the pressure exerted on the lifting hydraulic surface 51 exceeds the valve opening pressure, the needle valve member 50 is lifted against the action of the biasing spring 52, and fuel is allowed to spray into the combustion chamber from the nozzle outlet 43. During this portion of the injection event, various surfaces and passages are sized to raise the fuel pressure within the fuel pressurization chamber 40 above the valve opening pressure, the fuel pressure remains well below its maximum injection pressure. (See FIG. 4)

Figure 5:
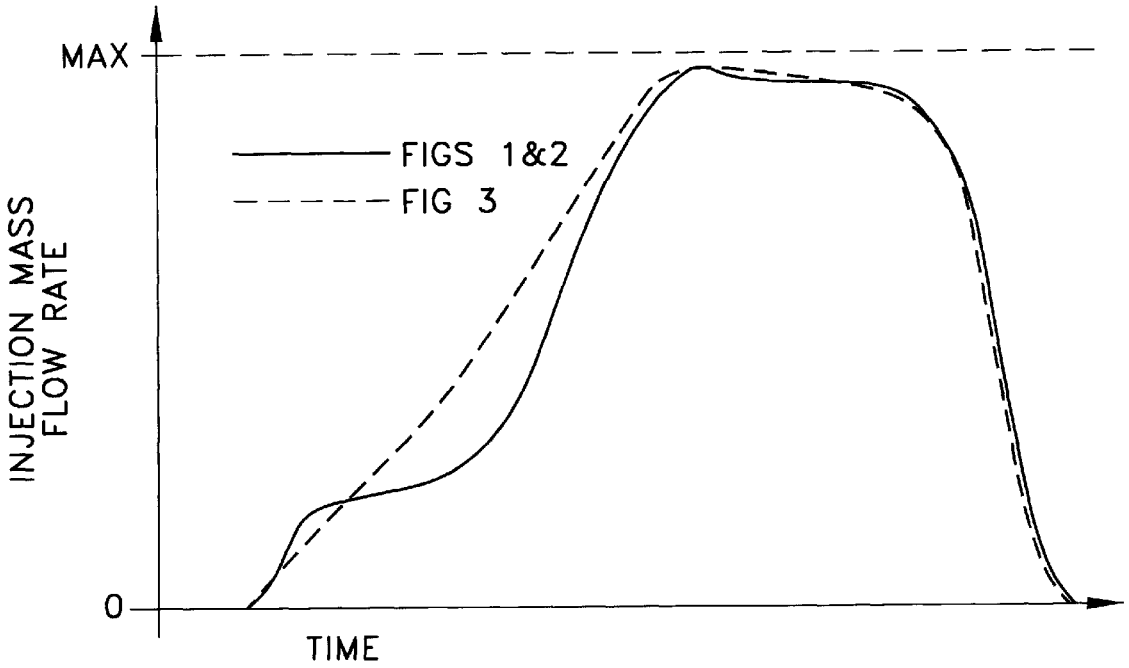
FIG. 5 is a graph showing the injection mass flow rate versus time for the invention embodiments shown in FIGS. 1–2 and 3, respectively.

As the injection event progresses, the intensifier piston 31 continues moving from its retracted position toward its advanced position. This advancing movement increases the flow area above the intensifier piston 31 thereby increasing the pressure within the hydraulic pressure cavity 29. This increase in pressure causes the intensifier piston 31 and the plunger 37 to accelerate. The downward movement of the plunger 37 increases the pressure of the fuel within the fuel pressurization chamber 40. This increase in fuel pressure increases the mass flow rate of the fuel out of the nozzle outlet 43. The embodiment of the invention depicted in FIGS. 1 and 2 is designed to produce a boot shaped injection profile. (See FIG. 5). This injection rate profile is accomplished by initially allowing the actuation fluid to enter the hydraulic pressure cavity 29 through one restricted actuation fluid passage 28. The embodiment of the invention depicted in FIG. 3 is designed to produce a ramp shaped injection profile. (See FIG. 5). The injection rate profile is accomplished by the gradual increase in flow area within the hydraulic pressure cavity 129 due to the partially restricted fluid passage 126.

As the pressure within the hydraulic pressure cavity 29 keeps building, the intensifier piston 31 continues to advance toward its advanced position. Once the flow from the primary actuation fluid passage 26 becomes completely unrestricted, the main injection event commences. At this time, the initially dynamic state of the injector's operating conditions reach a somewhat steady state. The injection event continues under this condition until the desired amount of fuel is injected into the combustion chamber. Shortly before the desired amount of fuel has been injected, a signal is sent to the solenoid 20 to end the injection event. The solenoid 20 then allows the control valve member 21 to return to the high pressure seat 22 under the action of the biasing spring 24. The high pressure actuation fluid inlet 12 is then closed preventing further flow of high pressure actuation fluid from the source 16. When the control valve member 21 returns to the high pressure seat 22, the low pressure actuation fluid drain 13 is opened. This causes the pressure in the actuation fluid cavity 25 to drop, resulting in a corresponding drop in pressure within the hydraulic pressure cavity 29. When the pressure in the hydraulic pressure cavity 29 drops, the intensifier piston 31, and the plunger 37 stop their downward stroke. Because the plunger 37 is no longer moving downward, the pressure of the fuel within the fuel pressurization chamber 40 begins to drop. When the pressure of this fuel falls below the valve closing pressure, the needle valve member 50 returns to its downward position to close the nozzle outlet 43 and end the injection event.

Between injection events various components of the injector body 11 begin to reset themselves in preparation for the next injection event. Because the pressure within the hydraulic pressure cavity 29 has dropped, the return spring 36 moves the intensifier piston 31 and the plunger 37 back to their retracted positions. The retracting movement of the intensifier piston 31 forces the actuation fluid from the hydraulic pressure cavity 29 and the actuation fluid cavity 25 into the drain reservoir 18 for recirculation. The retracting movement of the plunger causes fuel from the fuel inlet 14 to be pulled into the fuel pressurization chamber 40 through the fuel supply passage 45 past the check valve 46.

It should be understood that the above description is intended only to illustrate the concepts of the present invention, and is not intended to in any way limit the potential scope of the present invention. For instance, in addition to the ramp and boot shaped injections profiles described here, those skilled in the art should also appreciate that this invention could be used to create other injection profiles. Further modifications could include, but are not limited to, variations on the number of actuation fluid passages into the hydraulic pressure chamber, modifications to the shape or angle of the taper contained on the primary hydraulic surface, and modifications to the size of the actuation fluid passages leading into the hydraulic pressure chamber. Thus, various modifications could be made without departing from the intended spirit and scope of the invention as defined by the claims below.

What is claimed is:

1. A hydraulically actuated fuel injector including:

an injector body defining a supply passage opening to a hydraulic pressure cavity and defining a fuel pressurization chamber;

a piston positioned in said injector body and having a hydraulic surface exposed to fluid pressure in said hydraulic pressure cavity, and being movable between a retracted position and an advanced position;

a plunger being coupled to said piston and including a portion that is exposed to fluid pressure in said fuel pressurization chamber; and said supply passage being at least partially blocked by said piston when said piston is in said retracted position.

2. The hydraulically actuated fuel injector of claim 1 wherein said piston moves in a piston bore defined by said injector body; and said supply passage opens into said piston bore.

3. The hydraulically actuated fuel injector of claim 1 wherein a flow area from said supply passage into said hydraulic pressure cavity past said piston increases over a portion of said piston's movement from said retracted position toward said advanced position.

4. The hydraulically actuated fuel injector of claim 1 wherein said supply passage is unblocked by said piston over a majority of said piston's movement from said retracted position to said advanced position.

5. The hydraulically actuated fuel injector of claim 1 wherein said injector body defines a fuel inlet connected to a source of fuel fluid; and said supply passage is connected to a source of actuation fluid that is different from said fuel fluid.

6. The hydraulically actuated fuel injector of claim 1 wherein said hydraulic surface includes an annular taper.

7. The hydraulically actuated fuel injector of claim 1 wherein said supply passage opens to said hydraulic pressure cavity by both a first supply passage; and a second supply passage;

said second supply passage has a relatively restricted flow area; and said first supply passage and said second supply passage have a combined relatively unrestricted flow area.

8. The hydraulically actuated fuel injector of claim 7 wherein said first supply passage isblocked by said piston when said piston is in said retracted position.

9. The hydraulically actuated fuel injector of claim 7 wherein said second supply passage opens into said hydraulic pressure cavity above said piston.

10. The hydraulically actuated fuel injector of claim 1 wherein said supply passage opens to said hydraulic pressure cavity by only a single supply passage.

11. A hydraulically actuated fuel injector of claim 5 wherein a flow area from said supply passage into said hydraulic pressure cavity past said piston increases over a portion of said piston's movement from said retracted position toward said advanced position.

12. The hydraulically actuated fuel injector of claim 11 wherein said supply passage is unblocked by said piston over a majority of said piston's movement from said retracted position to said advanced position.

13. The hydraulically actuated fuel injector of claim 12 wherein said piston moves in a piston bore defined by said injector body; and said supply passage opens into said piston bore.

14. The hydraulically actuated fuel injector of claim 13 wherein said supply passage opens to said hydraulic pressure cavity by both a first supply passage;

said second supply passage has a relatively restricted flow area; and said first supply passage and said second supply passage have a combined relatively unrestricted flow area.

15. The hydraulically actuated fuel injector of claim 14 wherein said first supply passage is blocked by said piston when said piston is in said retracted position.

16. The hydraulically actuated fuel injector of claim 15 wherein said second supply passage opens into said actuation fluid cavity above said piston.

17. The hydraulically actuated fuel injector of claim 11 wherein said supply passage opens to said hydraulic pressure cavity by only a single supply passage.

18. A hydraulically actuated fuel injector including:

an injector body defining at least one supply passage opening to a hydraulic pressure cavity and defining a fuel pressurization chamber;

a piston positioned in said injector body and having a hydraulic surface exposed to fluid pressure in said hydraulic pressure cavity, and being movable between a retracted position and an advanced position, a plunger being coupled to said piston and including a portion that is exposed to fluid pressure in said fuel pressurization chamber; and wherein a flow area from said at least one supply passage into said hydraulic pressure cavity past said piston being relatively restricted when said piston is in said retracted position, but being relatively unrestricted over a majority of said piston's movement from said retracted position to said advanced position.

19. The hydraulically actuated fuel injector of claim 18 wherein said hydraulic surface includes an annular taper.

20. The hydraulically actuated fuel injector of claim 19 wherein said at least one supply passage opens to said hydraulic pressure cavity by both a first supply passage and a second supply passage;

said second supply passage has a relatively restricted flow area; and said first supply passage and said second supply passage have a combined relatively unrestricted flow area.

21. The hydraulically actuated fuel injector of claim 20 wherein said first supply passage is blocked by said piston when said piston is in said retracted position.

22. The hydraulically actuated fuel injector of claim 20 wherein said second supply passage opens into said hydraulic pressure cavity above said piston.

23. The hydraulically actuated fuel injector of claim 18 wherein said at least one supply passage opens to said hydraulic pressure cavity by only a single supply passage.

24. A hydraulically actuated fuel injector including:

an injector body defining at least one supply passage opening to a hydraulic pressure cavity;

a piston positioned in said injector body and having a hydraulic surface exposed to fluid pressure in said hydraulic pressure cavity, and being movable between a retracted position and an advanced position; and flow restriction means for causing a flow area from said at least one supply passage into said hydraulic pressure cavity past said piston to be relatively restricted when said piston is in said retracted position but less restricted as said piston moves from said retracted position to said advanced position.

25. The hydraulically actuated fuel injector of claim 24 wherein said flow restriction means causes said flow area to be relatively unrestricted over a majority of said piston's movement from said retracted position to said advanced position.

26. The hydraulically actuated fuel injector of claim 25 wherein said flow restriction means comprises means for at least partially blocking said supply passage when said piston is in said retracted position.

27. The hydraulically actuated fuel injector of claim 26 wherein said supply passage opens to said hydraulic pressure cavity by both a first supply passage and a second supply passage;

said second supply passage has a relatively restricted flow area; and said first supply passage and said second supply passage have a combined relatively unrestricted flow area.

28. The hydraulically actuated fuel injector of claim 26 wherein said supply passage opens to said hydraulic pressure cavity by only a single supply passage.

* * * * *